US007748201B2

(12) United States Patent
Poppi

(10) Patent No.: US 7,748,201 B2
(45) Date of Patent: Jul. 6, 2010

(54) FORM-AND-SEAL UNIT FOR A MACHINE FOR PACKAGING POURABLE FOOD PRODUCTS

(75) Inventor: Marco Poppi, I-Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 10/575,968

(22) PCT Filed: Oct. 21, 2004

(86) PCT No.: PCT/EP2004/052603

§ 371 (c)(1),
(2), (4) Date: Apr. 14, 2006

(87) PCT Pub. No.: WO2005/039983

PCT Pub. Date: May 6, 2005

(65) Prior Publication Data

US 2007/0068122 A1 Mar. 29, 2007

(30) Foreign Application Priority Data

Oct. 22, 2003 (EP) ..... 03425690

(51) Int. Cl.
*B65B 9/08* (2006.01)

(52) U.S. Cl. ..... 53/551; 53/374.5; 53/374.6; 53/552

(58) Field of Classification Search ..... 53/373.7, 53/551, 374.5, 552, 374.6
See application file for complete search history.

(56) References Cited

U.S. PATENT DOCUMENTS 4,384,438 A * 5/1983 Hilmersson ..... 53/51
4,387,547 A * 6/1983 Reil ..... 53/131.5
4,580,392 A * 4/1986 Lagerstedt et al. ..... 53/451
4,848,064 A * 7/1989 Lems et al. ..... 53/459
5,001,891 A * 3/1991 Abate ..... 53/551
5,155,980 A * 10/1992 Mansson et al. ..... 53/551
6,038,838 A * 3/2000 Fontanazzi ..... 53/551
6,085,496 A * 7/2000 Fontanazzi et al. ..... 53/551
6,112,498 A * 9/2000 Hansson et al. ..... 53/69
6,260,336 B1 * 7/2001 Motomura ..... 53/551
6,543,205 B1 * 4/2003 Faskhoody et al. ..... 53/373.7
7,104,028 B2 * 9/2006 Paradisi et al. ..... 53/374.5

FOREIGN PATENT DOCUMENTS

EP 1 101 700 A1 5/2001

* cited by examiner

*Primary Examiner*—Rinaldi I. Rada
*Assistant Examiner*—Gloria R. Weeks
(74) *Attorney, Agent, or Firm*—Buchanan Ingersoll & Rooney PC

(57) ABSTRACT

A form-and-seal unit for producing aseptic sealed packages from a tube of packaging material filled with a pourable food product. The unit comprises a fixed structure and two forming assemblies which interact alternately and cyclically with the tube of packaging material, and have respective pairs of jaws movable between an open position and a closed position in which they grip the packaging material tube between respective sealing means, and respective forming flaps selectable from different types of forming flaps for producing different types of packages, and having respective half shell forming portions which surround the tube of packaging material to determine the volume and shape of the packages. The approach movement of the forming flaps towards the packaging material tube is controlled by a fixed cam mechanism having different work profiles selectively engaged by cam-follower rollers of the forming flaps depending on the type of forming flaps used.

8 Claims, 3 Drawing Sheets

FORM-AND-SEAL UNIT FOR A MACHINE FOR PACKAGING POURABLE FOOD PRODUCTS

TECHNICAL FIELD

The present invention relates to a form-and-seal unit for a machine for packaging pourable food products.

BACKGROUND ART

Machines for packaging pourable food products, such as fruit juice, wine, tomato sauce, pasteurized or long-storage (UHT) milk, etc., are known, in which the packages are formed from a continuous tube of packaging material defined by a longitudinally sealed web.

The packaging material has a multilayer structure comprising a layer of paper material covered on both sides with layers of heat-seal material, e.g. polyethylene. In the case of aseptic packages for long-storage products, such as UHT milk, the packaging material comprises a layer of barrier material, defined for example by aluminium foil, which is superimposed on a layer of heat-seal plastic material, and is in turn covered with another layer of heat-seal plastic material defining the inner face of the package eventually contacting the food product.

To produce aseptic packages, the web of packaging material is unwound off a reel and fed through an aseptic chamber, in which it is sterilized, e.g. by applying a sterilizing agent such as hydrogen peroxide which is later evaporated by heating, and/or by subjecting the packaging material to radiation of appropriate wave length and intensity. The sterilized web is then folded into a cylinder and sealed longitudinally to form, in known manner, a continuous, longitudinally sealed, vertical tube. In other words, the tube of packaging material forms an extension of the aseptic chamber, and is filled continuously with the pourable food product and then fed to a forming and (transverse) sealing unit for producing the individual packages, and in which it is gripped between pairs of jaws, which seal the tube transversely to form pillow packs which are then separated by cutting the seal between the packs.

More specifically, the tube portion compressed between the jaws is simultaneously sealed crosswise by heating, e.g. induction or ultrasonic heating, means carried by the jaws themselves. Once sealing is completed, a knife is activated to cut the tube of packaging material along the centre of the sealed portion and detach a pillow pack from the bottom end of the tube. The bottom end is therefore sealed crosswise, and the jaws open to avoid interfering with the tube and the other pair of jaws. At the same time, the other pair of jaws, activated in the same way, moves down from a top dead-centre position, and repeats the above gripping/forming, sealing and cutting operations.

The pillow packs are then conveyed to a finish folding station, where they are folded mechanically to form the finished packages.

Known units also comprise, for each pair of jaws, two facing forming flaps hinged to the jaws and movable between a withdrawn or open position, and a forward or closed position in which they mate, when the jaws are closed, to define a cavity defining the shape and volume of the package to be formed between them.

In one known solution, the closing movement of the forming flaps is controlled by cams fixed to the machine structure, and which are specifically sized and located to produce a given type of package, and interact with respective rollers carried by the tabs.

Machines of the above type have been extremely successful commercially, and have proved extremely reliable, to the extent of requiring very little maintenance, even after many years' service.

On the other hand, they have several drawbacks caused, in particular, by being fairly rigid production-wise.

That is, machines of the above type can be adapted to produce packages of different volumes, but only at the expense of major alterations to the machine, which include replacing the forming flaps on the jaws, replacing all the parts, even static (such as the cams), controlling the closing movement of the tabs, and subsequently adjusting the new system. In addition to the manufacturing cost of the new component parts, such alterations therefore also involve a good deal of downtime.

One solution to the above problem is described in EP-A-1 101 700, which describes a form-and-seal unit in which the closing movement of the forming flaps onto the tube of packaging material is controlled by cams carried by the forming flaps themselves and interacting with rollers fixed to the unit structure, so that the volume of the packages produced can be modified by simply changing the forming flaps (which, being designed for a specific type of package, must be changed anyway at each production change) with no work needed on the static parts of the machine.

Even the above solution, however, is not without drawbacks. That is, the fact that the cams controlling the closing movement of the forming flaps are fitted to the tabs themselves increases the weight of the moving component parts, and so creates dynamic problems and poses limits to the output rate. Moreover, the geometry of the system poses serious restrictions on the movement to prevent interference by the cams.

DISCLOSURE OF INVENTION

It is an object of the present invention to provide a form-and-seal unit designed to eliminate the aforementioned problems typically associated with known units.

According to the present invention, there is provided a form-and-seal unit as claimed in claim 1.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 2:
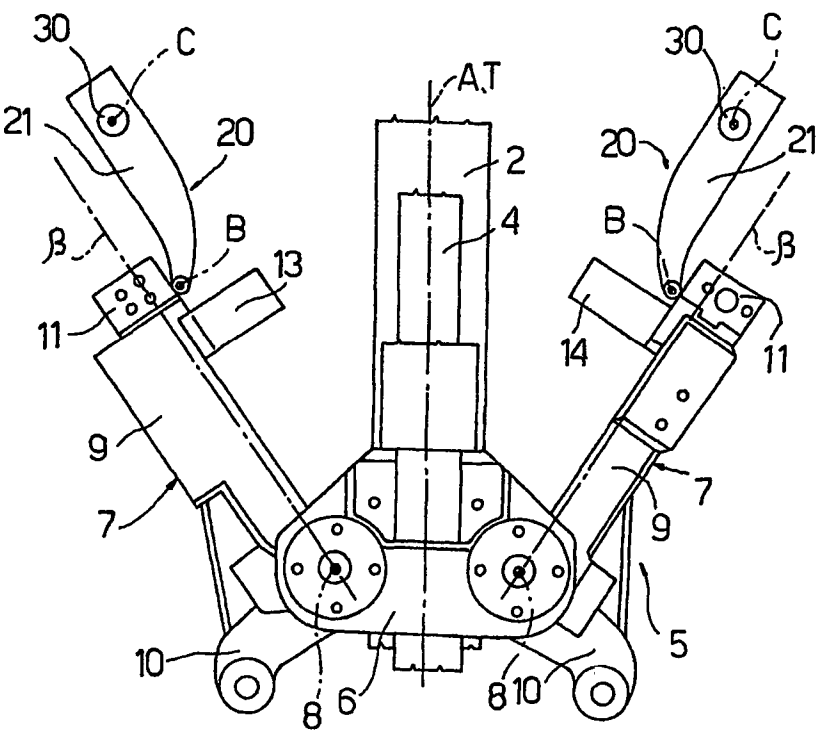
FIG. 2 shows a schematic partial side view of a form-and-seal assembly of the FIG. 1 unit.
Figure 1:
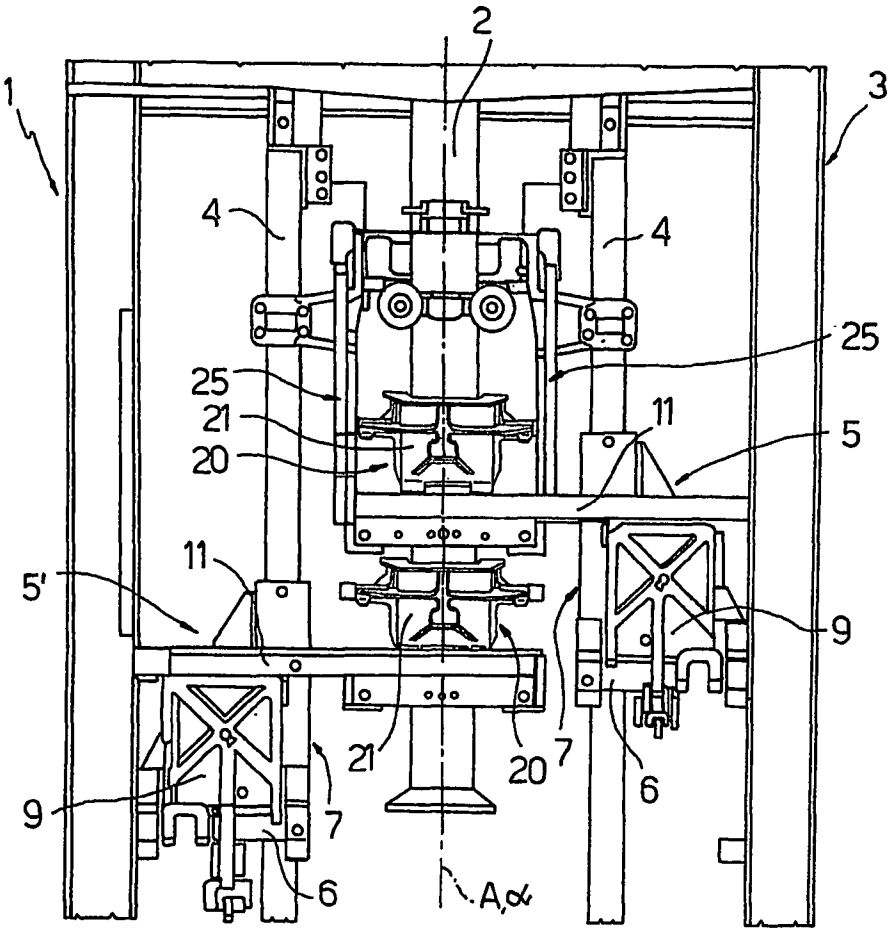
FIG. 1 shows a schematic front view of a form-and-seal unit for a machine for packaging pourable food products, in accordance with the teachings of the present invention.

With reference to FIGS. 1 and 2, number 1 indicates as a whole a form-and-seal unit for a machine for packaging pourable food products, such as pasteurized or UHT milk, fruit juice, wine, etc.

More specifically, unit 1 is designed to produce aseptic sealed packages of a pourable food product from a tube 2 of packaging material (FIG. 1) formed by longitudinally folding and sealing a web of heat-seal sheet material, and filled upstream from unit 1 with the food product for packaging.

Tube 2 is fed to unit 1 in known manner along a vertical path defined by an axis A.

Unit 1 comprises a supporting structure 3 defining two vertical guides 4, which are located symmetrically with respect to a vertical longitudinal central plane a of the unit through axis A, and the axes of which lie in a vertical transverse central plane $\tau$ of unit 1. Axis A thus defines the intersection of plane $\alpha$ and plane $\tau$.

Unit 1 comprises, in known manner, two forming assemblies 5, 5' movable vertically along respective guides 4, and which interact alternately with tube 2 of packaging material to grip and heat seal it along cross sections of the tube.

Assemblies 5, 5' being symmetrical with respect to plane $\alpha$, only one (assembly 5) is shown in more detail in FIG. 2 and described below. Moreover, since the assemblies are known, only the parts pertinent to a clear understanding of the present invention are described; and the corresponding parts of assemblies 5, 5' are indicated in the drawings using the same reference numbers.

With reference to FIG. 2, assembly 5 substantially comprises a slide 6, which slides along respective guide 4; and two jaws 7, which are hinged at the bottom to the slide, about respective parallel horizontal axes 8 symmetrical with respect to plane $\tau$, so as to open and close substantially "book-fashion".

More specifically, each jaw 7 comprises a main control body 9, substantially in the form of a suitably ribbed quadrangular plate (FIG. 1) extending along a work plane $\beta$ of jaw containing respective axis 8, which is hinged, close to its bottom side, to slide 6, and comprises a respective control arm 10 projecting from the face of body 9 facing away from plane $\tau$.

Jaws 7 also comprise respective supporting arms 11, which are fixed to the top ends of respective bodies 9 of respective jaws 7, and project towards and beyond plane $\alpha$, in a direction parallel to respective axes 8 and substantially along respective work planes $\beta$, so as to be located on opposite sides of tube 2.

The projecting portions of arms 11 are fitted with respective bar-shaped sealing members 13, 14 (FIG. 2), which interact with tube 2, and which may be defined, for example, by an inductor for generating current in the aluminium layer of the packaging material and Joule-effect melting the thermoplastic layer, and by a contrasting pad by which to grip the tube to the required pressure.

The reciprocating movement of slide 6 and the opening/closing movement of jaws 7 are controlled, in known manner not described, by pairs of vertical rods (not shown) in turn controlled by rotary cams or servomotors.

Jaws 7 are movable between a closed position (not shown), in which respective sealing members 13, 14 grip tube 2, and a fully-open position (FIG. 2).

Over respective sealing members 13, 14, arms 11 of jaws 7 are fitted with respective package-volume-control assemblies 20.

Each assembly 20 comprises two forming flaps 21 hinged to respective jaws 7, about respective parallel horizontal axes B symmetrical with respect to plane $\tau$, and which cooperate with each other, when forming the packages, to enclose tube 2 and mold it into a rectangular-section configuration corresponding to that of the finished packages.

FIGS. 4, 6 and 5, 7 respectively show two different embodiments of forming flaps 21, indicated 21*a* and 21*b* respectively, for forming packages of different volumes. More specifically, tabs 21*b* are designed to form small packages, such as so-called 200 ml "portion packs", and tabs 21*a* to form larger, e.g. 1-litre, packages.

When describing characteristics common to both, and unless otherwise stated, forming flaps 21*a* and 21*b* are collectively referred to as tabs 21.

Figure 3:
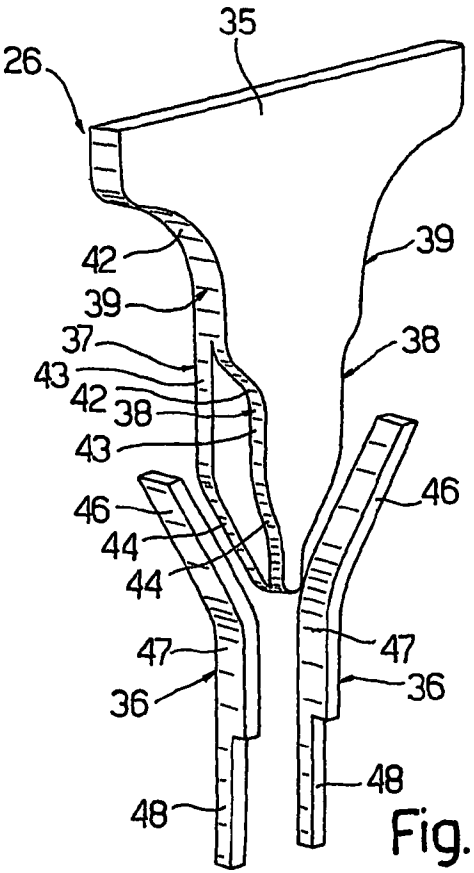
FIG. 3 shows a partial view in perspective of a cam control assembly of the FIG. 1 unit.

Forming flaps 21 each comprise a half-shell portion 22 defining a cavity 23 of substantially the same shape and volume as half of the package being produced; and two lateral control arms 24 extending from opposite sides of the half-shell portion and cooperating with respective cam control assemblies 25 shown in FIGS. 3, 6 and 7 and described in detail later on.

More specifically, half-shell portion 22 comprises a back wall 28 hinged along its bottom end to respective jaw 7 about axis B; and two lateral walls 29, which project frontwards from opposite sides of back wall 28, and decrease gradually in height, in known manner, towards the bottom end of half-shell portion 22, to avoid interfering with the complementary half-shell portion 22 when moving towards and about tube 2.

Control arms 24 extend parallel to axis B, and are fitted on the ends with respective cam-follower rollers 30 of axis C parallel to axis B.

Figure 4:
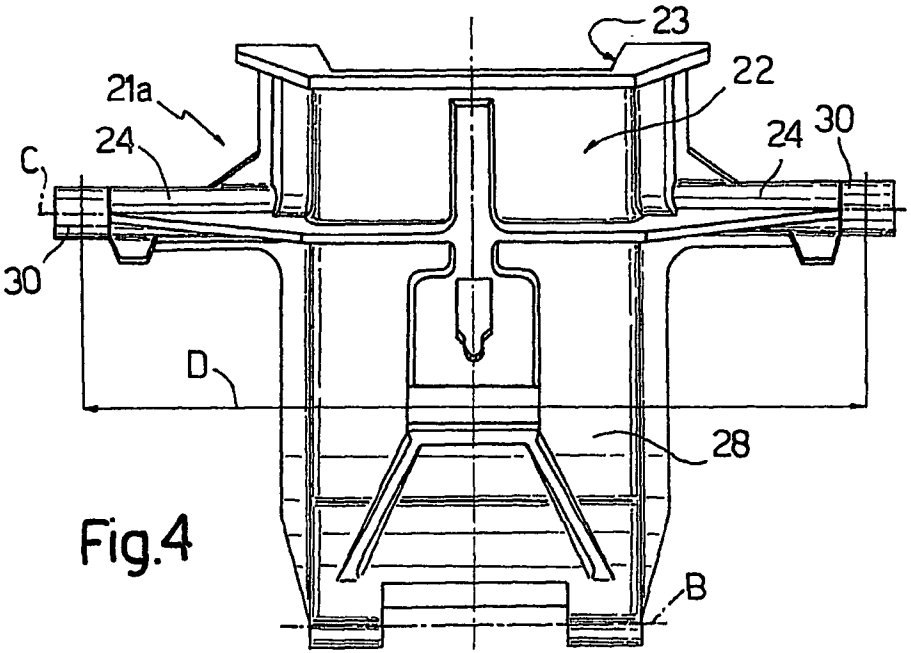
FIGS. 4 and 5 show elevations of two different forming flaps usable selectively on the FIG. 1 unit to respectively produce first and second packages of different volumes.
Figure 5:
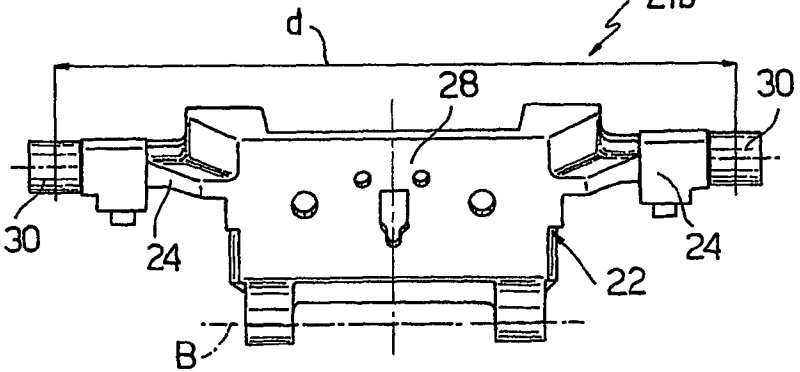

As can be seen from a comparison of FIGS. 4 and 5, in addition to the shape and size of respective half-shell portions 22, tabs 21*a* and 21*b* also differ as regards the distance between rollers 30. More specifically, rollers 30 of tabs 21*a* are separated by a distance D (measured, for example, between the central transverse planes of the rollers) greater than the corresponding distance between rollers 30 of tabs 21*b*.

Each forming flap 21 is pushed, in known manner by elastic means not shown, into a forward or closed position defined by an adjustable stop device (not shown), and in which back wall 28 is substantially parallel to work plane $\beta$ of the respective jaw (FIG. 2). One embodiment of the elastic means and stop device is illustrated in EP-A-1 101 700.

Figure 7:
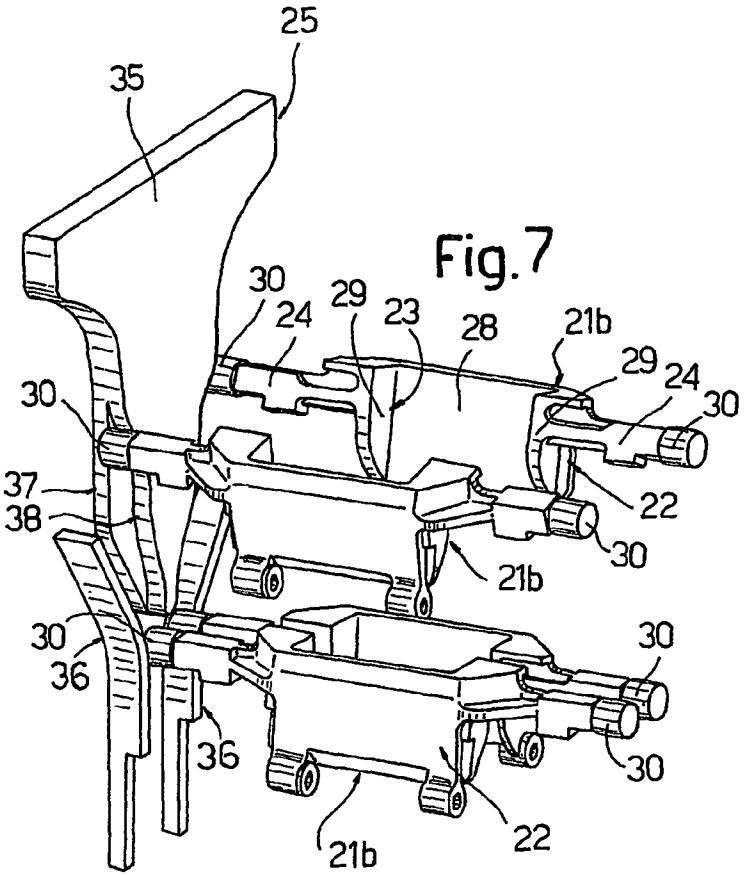
FIG. 7 shows a partial view in perspective, with parts removed for clarity, of the form-and-seal unit fitted with forming flaps as shown in FIG. 5.
Figure 6:
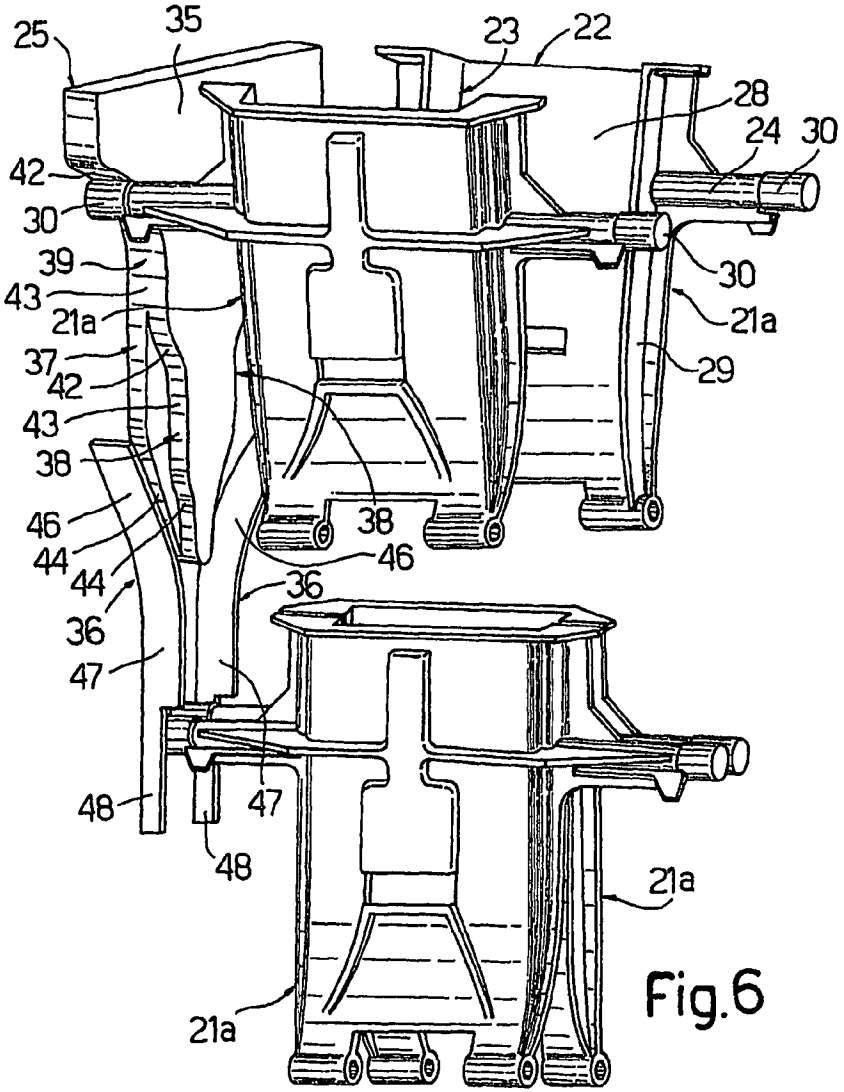
FIG. 6 shows a partial view in perspective, with parts removed for clarity, of the form-and-seal unit fitted with forming flaps as shown in FIG. 4.

The approach and closing movement of forming flaps 21 towards and about tube 2 of packaging material is controlled in known manner by the two cam control assemblies 25, which are fixed to structure 3 and located alongside forming assemblies 5, 5' to interact with rollers 30 of forming flaps 21 during the movement of jaws 7 (FIGS. 6 and 7).

Cam control assemblies 25 each comprise a top cam 35 for controlling the approach movement of tabs 21, and two bottom cams 36 for controlling the closing movement of the tabs.

Cam 35 is defined by a flat plate parallel to plane $\alpha$ and forming two pairs of work profiles 37, 38 (FIGS. 3, 6 and 7) which cooperate with rollers 30 of tabs 21*a* and rollers 30 of tabs 21*b* respectively.

Work profiles 37 and 38 are defined by lateral edges 39 of cam 35; and the two profiles 37 and the two profiles 38 are symmetrical with each other with respect to plane $\tau$.

Cams 35 of the two cam control assemblies 25 are symmetrical with respect to plane $\alpha$. Profiles 37 and 38 of each cam 35 are defined by respective longitudinal bands of edges 39 offset in the direction of the thickness of cam 35. In other words, profiles 37 and 38 are located different distances from plane α. Which distances—greater for profiles 37 than for profiles 38—are calculated so that rollers 30 of tabs 21*a* cooperate with profiles 37, and rollers 30 of tabs 21*b* cooperate with profiles 38 (FIGS. 6 and 7 respectively), and the maximum opening angle of forming flaps 21 can also be made independent of the distance between axes C and B (FIGS. 4 and 5).

Though differing substantially in size, profiles 37 and 38 are similar in shape, and may each comprise a curved concave top inlet portion 42, the distance of which from plane τ decreases gradually downwards; a straight vertical intermediate portion 43; and a straight sloping bottom outlet portion 44 converging downwards with respect to plane τ.

Profiles 38 of tabs 21*b*, whose rollers 30 are closer together, conveniently lie within the area defined by profiles 37, when viewed in a direction perpendicular to plane α, so as to avoid interference between rollers 30 of tabs 21*a* and profiles 38 of tabs 21*b*.

Bottom cams 36 of each assembly 25 are located at the outlet of top cam 35, and each comprise a top portion 46 converging downwards with respect to plane τ, and a bottom portion 47 substantially parallel to plane τ. Top portions 46 are located on either side of outlet portions 44 of cam 35, so as to intercept respective rollers 30 of tabs 21 as they are released from top cam 35.

Unlike top cams 35, tests have shown that bottom cams 36 may have a single work profile wide enough to cooperate with rollers 30 of both tabs 21*a* and tabs 21*b*.

Portions 47, however, have extensions 48 of the profile portion designed to cooperate with rollers 30 of tabs 21*a*, which interact longer with tube 2 on account of the larger size of the packages produced. Rollers 30, in fact, must be maintained inside cams 36 until the two top jaws 7 are fully closed, as described in detail later on.

Form-and-seal unit 1 operates as follows.

The movement of jaws 7 to seal tube 2 transversely is known and therefore only described briefly below.

Jaws 7 of each assembly 5, 5' close as the assembly moves down, so as to grip tube 2 with a downward vertical component of motion equal to the travelling speed of tube 2. Jaws 7 are kept closed as they move down, and sealing members 13, 14 grip the tube with sufficient pressure to heat seal it. Close to the bottom dead-centre position, jaws 7 open to release tube 2, and are opened fully as they move up and before reaching the top dead centre position. At which point, the jaws begin closing again as described above.

The movement of the two assemblies 5, 5' is obviously offset by a half-period: assembly 5 moves up with jaws 7 open, at the same time as assembly 5' moves down with the jaws closed, so that arms 11 of assembly 5' pass between, and without interfering with, the arms of assembly 5.

Forming flaps 21 on jaws 7 interact with tube 2 of packaging material in coordination with the action of the jaws; and the approach and closing movements of tabs 21 towards and about tube 2 are controlled respectively by top cams 35 and bottom cams 36 interacting with rollers 30 of forming flaps 21.

The above movements are substantially known and therefore only described briefly below.

Upon sealing members 13, 14 first contacting tube 2, but before the tube is contacted by tabs 21, rollers 30 of forming flaps 21 come into contact with top inlet portions 42 of top cams 35 (top half of FIGS. 6 and 7), so that tabs 21 are moved gradually, along portions 42, into a withdrawn or open position (not shown), which is maintained along vertical intermediate portions 43 of top cams 35, along which the movement of jaws 7, by now closed, is also purely vertical.

Along outlet portions 44 of cams 35, tabs 21 are gradually allowed to close about tube 2 under the control of respective springs (not shown). Immediately downstream from cams 35, control of the movement of forming flaps 21 is taken over by cams 36 to counteract the internal pressure of tube 2 and accurately define the volume of the package being formed. The bottom half of FIG. 6 shows the fully-closed condition of tabs 21, which occurs along bottom portions 47 of cams 36, and in which half-shell portions 22 completely surround tube 2 and substantially mate to impose the shape and volume of the inner cavity defined by them onto tube 2.

Tabs 21 are secured positively in the above closed position until rollers 30 disengage bottom cams 36.

This takes place when jaws 7 of the other forming assembly 5' have already gripped tube 2 by the next seal portion to close the package being formed, so that jaws 7 of assembly 5 can open and detach forming flaps 21 from the package.

The advantages of form-and-seal unit 1 according to the present invention will be clear from the foregoing description.

In particular, according to the present invention, the movement of forming flaps 21 is controlled by fixed cams having different work profiles 37, 38 selectively engageable by cam-follower rollers 30, depending on the type of tabs 21*a*, 21*b* being used. As such, the volume of the packages produced can be modified by simply changing tabs 21 (which, being designed for a specific type of package, must be changed anyway at each production change), but with no work needed on the static parts of the machine.

Since cams 35 are fixed, and tabs 21 simply support cam-follower rollers 30, and are therefore identical with conventional tabs, production is made more flexible with no increase in the moving weights, and therefore with no dynamic problems and no restriction in output rate.

The size of the moving parts (tabs 21) and the complexity of the jaw system can also be reduced, and the components of different machine configurations further standardized as different container formats are introduced.

Clearly, changes may be made to the unit as described herein without, however, departing from the scope of the accompanying Claims.

In particular, cams 35 may have more than two different profiles, in the event the unit is required to produce more than two types of package.

Moreover, unit 1 may be a chain, as opposed to an alternating-jaw, type, i.e. may comprise two groups of jaws and counter-jaws connected to form respective continuously-moving chains, so that one jaw of one chain and a corresponding counter-jaw of the other chain cyclically engage the tube of packaging material.

The invention claimed is:

1. A form-and-seal unit for producing aseptic sealed packages of a pourable food product from a tube of packaging material filled with the food product and fed along a vertical path, the unit comprising:

two spaced apart guides;

two forming assemblies movable along the spaced apart guides;

each forming assembly comprising a pair of jaws having sealing means for sealing the tube of packaging material and movable between an open position and a closed position in which the sealing means cooperate with the tube of packaging material;

a forming flap carried by each jaw and having a respective half-shell forming portion, the forming flaps of each pair of jaws being movable between a withdrawn position in which they do not cooperate with the tube and a forward position in which the respective half-shell forming portions surround the tube in the closed position of the respective jaws to form a cavity of predetermined volume a fixed cam formed as a flat plate;

cam-followers carried by the forming flaps, the cam-followers contacting and moving along respective work profiles of the fixed cam during operation of the unit to control approach movement of the forming flaps from the withdrawn position to the forward position;

the work profiles of the fixed cam comprising a first pair of work profiles and a second pair of work profiles which differ in size from one another, the work profiles forming the first pair of work profiles being spaced apart from one another in a width-wise direction of the fixed cam, the first pair of work profiles being offset from the second pair of work profiles in a thickness direction of the flat plate forming the fixed cam, with the first pair of work profiles being contacted by the cam followers of two forming flaps of a first type to control the approach movement of the two forming flaps of the first type towards each other and towards the tube, the second pair of work profiles being contacted by the cam followers of two forming flaps of a second type, which differ in size relative to the two forming flaps of the first type, to control the approach movement of the two forming flaps of the second type towards each other and towards the tube.

2. A unit as claimed in claim 1, wherein the first and second work profiles form a top cam of the fixed cam, and wherein the fixed cam also comprises a bottom cam which controls closing movement of the two forming flaps of the first type and the two forming flaps of the second type.

3. A unit as claimed in claim 2, wherein the bottom cam comprises a single pair of work profiles which are engageable by the cam followers of the two forming flaps of the first type and the cam followers of the two forming flaps of the second type.

4. A unit as claimed in claim 1, wherein the first and second work profiles are positioned at a top portion of the plate forming the fixed cam.

5. A form-and-seal unit for producing aseptic sealed packages of a pourable food product from a tube of packaging material filled with the food product and fed along a vertical path, the unit comprising:

two spaced apart guides;

two forming assemblies movable along the spaced apart guides;

each forming assembly comprising a pair of jaws having sealing means for sealing the tube of packaging material and movable between an open position and a closed position in which the sealing means cooperate with the tube of packaging material;

a forming flap carried by each jaw and having a respective half-shell forming portion, the forming flaps of each pair of jaws being movable between a withdrawn position in which they do not cooperate with the tube and a forward position in which the respective half-shell forming portions surround the tube in the closed position of the respective jaws to form a cavity of predetermined volume two cam-follower rollers mounted on each forming flap and spaced apart from one another;

two fixed cams each formed as a flat plate and spaced apart from one another;

the two fixed cams each comprising a first pair of work profiles and a second pair of work profiles which differ in size from one another, the first pair of work profiles of each fixed cam being spaced apart from one another in a width-wise direction of the fixed cam, the first pair of work profiles of each fixed cam being offset from the second pair of work profiles of the respective fixed cam in a thickness direction of the flat plate forming the respective fixed cam;

the first pair of work profiles of each fixed cam being contacted by one of the cam follower rollers of one of the forming flaps of a first type and one of the cam follower rollers of an other of the forming flaps of the first type to control approach movement of the one forming flap and the other forming flap of the first type towards each other and towards the tube during operation of the unit for producing packages of a first size; and the second pair of work profiles of each fixed cam being contacted by one of the cam follower rollers of one of the forming flaps of a second type and one of the cam follower rollers of an other of the forming flaps of the second type, which differ in size relative to the forming flaps of the first type, to control approach movement of the two forming flaps of the second type towards each other and towards the tube during operation of the unit for producing packages of a second size different from the first size.

6. A form-and-seal unit for producing aseptic sealed packages of a pourable food product from a tube of packaging material filled with the food product and fed along a vertical path, the unit comprising:

two spaced apart guides;

two forming assemblies movable along the spaced apart guides;

each forming assembly comprising a pair of jaws having sealing means for sealing the tube of packaging material and movable between an open position and a closed position in which the sealing means cooperate with the tube of packaging material;

two first forming flaps each adapted to be carried by the jaws of one pair and each having a respective half-shell-forming portion, the two first forming flaps being movable between a withdrawn position in which the two first forming flaps do not cooperate with the tube and a forward position in which the respective half-shell forming portions of the two first forming flaps surround the tube in the closed position of the respective jaws to form a first cavity of a first predetermined volume;

two second forming flaps each adapted to be carried by the jaws of the one pair and each having a respective half-shell-forming portion, the two second forming flaps being movable between a withdrawn position in which the two second forming flaps do not cooperate with the tube and a forward position in which the respective half-shell forming portions of the two second forming flaps surround the tube in the closed position of the respective jaws to form a second cavity of a second predetermined volume;

the two first forming flaps possessing a size different from the size of the two second forming flaps so that the first predetermined volume differs from the second predetermined volume;

two cam-follower rollers mounted on each of the first and second forming flaps and spaced apart from one another two fixed cams each formed as a flat plate and spaced apart from one another;

the two fixed cams each comprising a first pair of work profiles and a second pair of work profiles which differ in size from one another, the first pair of work profiles of each fixed cam being spaced apart from one another in a width-wise direction of the fixed cam, the first pair of work profiles of each fixed cam being offset from the second pair of work profiles of the respective fixed cam in a thickness direction of the flat plate forming the respective fixed cam;

the first pair of work profiles of each fixed cam being contacted by one of the cam follower rollers of one of the first forming flaps and one of the cam follower rollers of an other of the first forming flaps during operation of the unit to control approach movement of the one first forming flap and the other first forming flap towards each other and towards the tube; and the second pair of work profiles of each fixed cam being contacted by one of the cam follower rollers of one of the second forming flaps and one of the cam follower rollers of an other of the second forming flaps of the second type during operation of the unit to control approach movement of the one second forming flap and the other second forming flap towards each other and towards the tube.

7. A unit as claimed in claim 6, wherein the two cam-follower rollers mounted on one of the first forming flaps are spaced apart a first distance measured from a central plane of each of the two cam-follower rollers mounted on the one first forming flap, and the two cam-follower rollers mounted on an other of the first forming flaps are spaced apart the first distance measured from a central plane of each of the two cam-follower rollers mounted on the other first forming flap, and wherein the two cam-follower rollers mounted on one of the second forming flaps are spaced apart a second distance measured from a central plane of each of the two cam-follower rollers mounted on the one second forming flap, and the two cam-follower rollers mounted on an other of the second forming flaps are spaced apart the second distance measured from a central plane of each of the two cam-follower rollers mounted on the other second forming flap, the first distance being different from the second distance.

8. A unit as claimed in claim 7, wherein the two first forming flaps possess a size smaller than the size of the two second forming flaps, and the first distance is less than the second distance.

* * * * *